United States Patent [19]

Kizer et al.

[11] Patent Number: 4,905,647

[45] Date of Patent: Mar. 6, 1990

[54] THROTTLE BODY

[75] Inventors: Thomas L. Kizer, Farmington Hills; Stephen R. Brueckner, Livonia, both of Mich.

[73] Assignee: Chrysler Motors Corporation, Highland Park, Mich.

[21] Appl. No.: 209,121

[22] Filed: Jun. 20, 1988

[51] Int. Cl.[4] ..... F02D 9/10

[52] U.S. Cl. ..... 123/337; 123/403; 251/118; 251/208; 251/305

[58] Field of Search ..... 123/337, 403; 251/118, 251/305, 208; 261/65

[56] References Cited

U.S. PATENT DOCUMENTS

| | | | |
|---|---|---|---|
| 1,186,976 | 6/1916 | Dugrey . | |
| 1,226,805 | 5/1917 | Patterson . | |
| 2,034,263 | 3/1936 | Maybach | 123/403 |
| 2,436,319 | 2/1948 | Meyer | 261/41 |
| 2,737,375 | 3/1956 | Kittler | 261/23 |
| 2,920,858 | 1/1960 | Hunter | 251/118 |
| 3,047,277 | 7/1962 | Landrum | 261/65 |
| 3,341,185 | 9/1967 | Kennedy, Sr. | 261/41 |
| 3,364,911 | 1/1968 | Baudry et al. | 123/337 |
| 3,666,235 | 5/1972 | Scott | 251/118 |
| 3,985,837 | 10/1976 | Rock | 251/208 |
| 4,308,837 | 1/1982 | Nohira et al. | 123/442 |
| 4,391,247 | 7/1983 | Shioyama et al. | 123/403 |
| 4,474,150 | 10/1984 | Foley et al. | 123/337 |
| 4,491,106 | 1/1985 | Morris | 123/337 |
| 4,572,478 | 2/1986 | Vogler et al. | 251/305 |
| 4,582,653 | 4/1986 | Blanchard et al. | 261/65 |

FOREIGN PATENT DOCUMENTS

| | | | |
|---|---|---|---|
| 2575518 | 7/1986 | France | 261/65 |

*Primary Examiner*—Andrew M. Dolinar

*Attorney, Agent, or Firm*—Kenneth H. MacLean, Jr.

[57] ABSTRACT

A throttle body defining a passageway and including a throttle valve formed by a pivoting plate is profiled to include a venturi nozzle whose converging wall lies adjacent the path of the plate periphery. The radius, and other characteristics of the converging wall reduces the change of flow rate throughout the low range of throttle travel to reduce sensitivity to throttle actuator position. Furthermore, the venturi nozzle profile is configured in accordance with standard engineering characteristics to avoid pressure differential which restricts air flow rate through the passage and maintains a high maximum flow rate through the throttle passage. Moreover, the profile can be formed by simple mold parts or simple machining apparatus for ease of construction.

4 Claims, 2 Drawing Sheets

FIG 1
PRIOR
ART
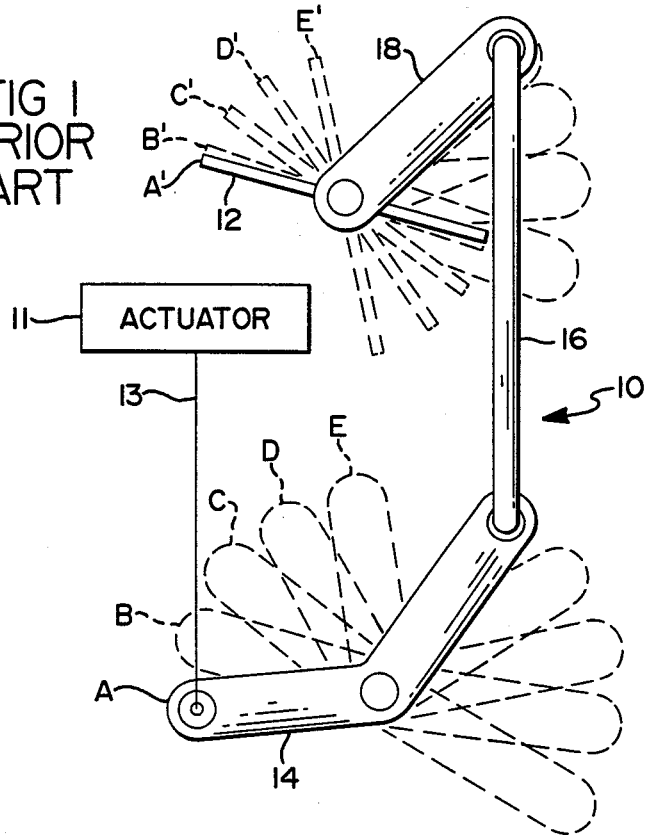
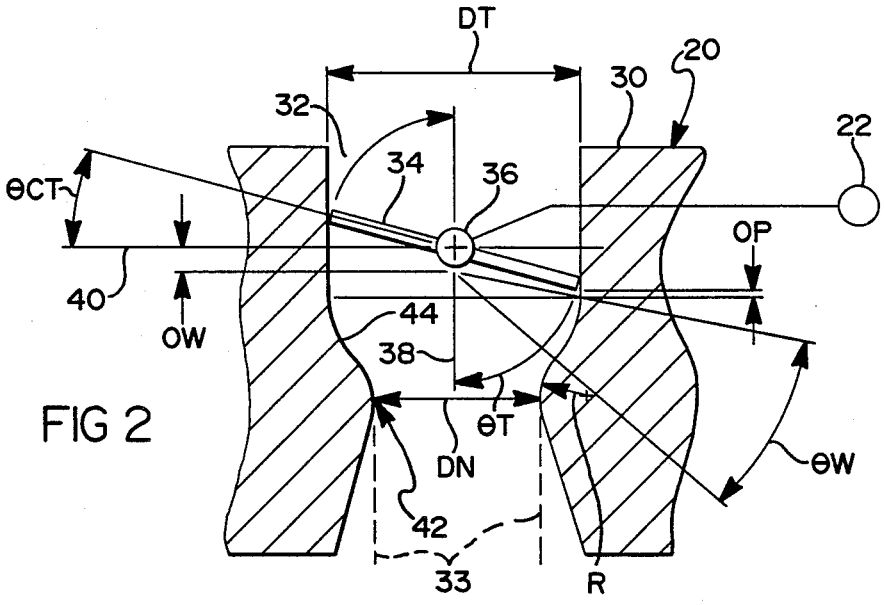
FIG 2

THROTTLE BODY

BACKGROUND OF THE INVENTION

I. Field of the Present Invention

The present invention relates generally to throttle body constructions including a throttle valve, and more particularly to a throttle passage profile for adjusting the change in rate of fluid flow through the throttle passage throughout a range of valve travel.

II. Description of the Prior Art

Throttle bodies including a passage through which the flow of air or a fuel-air mixture is controlled by angular variation of a throttle valve are well known. Typically, the throttle valve is a butterfly valve formed by a plate pivoted about an axis perpendicular to the longitudinal axis of the passage. The angular position of the plate varies in response to a throttle control mechanism. Typically, the actuator for the throttle control mechanism includes an accelerator pedal mounted for access to the vehicle operator within the vehicle passenger compartment. In a closed throttle position, the throttle valve plate is positioned to engage the periphery of the throttle body passage and close off flow through the throttle body. As the actuator i.e. accelerator pedal, is displaced, the control mechanism varies the angular position of the plate so as to increase the area through which fluid may flow through the throttle body passage.

It may be appreciated that the rate of change of the flow through the throttle passage varies throughout the angular variation of the throttle plate as a function of the area of the throttle passage which is obstructed by the throttle plate at the various angular positions of the plate. However, initial rate of change of the flow through the throttle body passage from a closed throttle plate position in response to actuation of the accelerator pedal is greater than has been found to be desirable to initiate movement of the vehicle under actual driving conditions. In particular, a high rate of change in the early range of throttle movement renders engine speed response more sensitive to pedal position than is desirable to comfortably accommodate small changes in vehicle velocity at the low range of throttle movement.

One way in which the rate of change of fluid flow through the throttle body in the early range of throttle movement can be reduced is by reducing the cross-sectional area of the throttle body passage. Unfortunately, a disadvantage of the reduction of the diameter or cross-sectional area of the throttle body passage is that the maximum rate of fluid flow through the passage is limited. Another previously known apparatus used with large area throttle passages is a mechanical linkage between the actuator and the throttle valve to reduce the sensitivity of the fluid flow to pedal actuation in the lower range of throttle movement. However, such linkages require the design, production and assembly of numerous components. Such a mechanism varies the amount by which a throttle plate angle is changed in response to displacement of the throttle actuator or accelerator pedal. Such mechanisms substantially increase the cost and complexity of producing and repairing the motor vehicle.

A diagrammatic example of such a linkage is shown in FIG. 1. The figure illustrates only a general relationship of the numerous links and connections necessary to control movement of the throttle plate 12 in the desired manner and does not disclose the numerous details of the components including such parameters as shaping, clearances and manufacturing tolerances, or the modifications of environmental structures, which must also be taken into account to build and mount or package the linkage in an operable manner on the vehicle. Nevertheless, the diagram is adequate for purpose of demonstrating the general operation and structure of the prior art device for comparison with the present invention.

In FIG. 1, an actuator 11 is shown in solid line at the closed throttle extreme of its range of movement. The actuator is connected to one end of a pivoted bellcrank 14. The other end of the bellcrank 14 is pivotally coupled to a connecting link 16. The connecting link 16 is in turn pivotally connected to a throttle lever 18. The throttle lever 18 is coupled to the valve plate 1 to control its angular orientation within the throttle passage. As shown in solid line in FIG. 1, positioning of the bellcrank 14 at position A results in positioning of the valve plate 12 at a closed throttle position A'. Displacement of the actuator 11 through one-quarter of its range of movement repositions the bell crank to a position B at which the linkage 10 angularly displaces the valve plate 12 only a small amount to the position shown at b'. The linkage 10 mechanically translates movement of the actuator through one-quarter of its range into a small angular displacement of the plate 12, for example, three and one-half degrees from the closed throttle position rather than one-quarter of a full 77° range. Further displacement of the actuator to the half-way point of its range movement reorients the bell crank 14 to the position C shown in FIG. 1, whereby the throttle plate 12 moves to the position C', for example, approximately 18° from the position B'. Movement of the actuator to a position at three-quarters of its full range orients the bellcrank 14 at the position D, thereby displacing the throttle plate 12 to the position D' approximately eighteen and one-half degrees away from position C'. Finally, full actuation of the throttle actuator through its full range of movement reorients the bell crank 14 to the position E, whereby the linkage orients the throttle plate 12 at a wide open throttle position, for example, twenty two and one-half degrees beyond the position D'.

Although modifications of the shape of the throttle passage have been known, none of the passageway modifications disclosed in the prior art particularly address the problem of reducing sensitivity of pedal actuation at the low range of throttle movement. One previously known configuration for throttle body construction is disclosed in U.S. Pat. No. 4,391,247 to Shioyama et al. This patent discloses a throttle body profile used in conjunction with a variable resistor to form a simple sensor in which the resistance varies sufficiently throughout the frequently used low throttle settings. The throttle body passage is profiled so that the wall maintains predetermined distances from the throttle valve path throughout the initial or low range of angular displacement of the throttle valve. While the profile conforms generally with the path to reduce the rate of change of fluid flow past the throttle valve in the frequently used low range, the patent teaches that the resulting reduction in accelerator sensitivity is undesirable. Consequently, the patent specifically teaches a device to compensate for this desensitization of the accelerator pedal.

In addition, the throttle wall profiles disclosed by Shioyama have the disadvantageous effect of reducing the maximum flow rate through the throttle body passage. Furthermore, the profile constructions of the throttle body walls are difficult to construct. For example, the profiles include a negative draft which would render die casting of the device difficult if not impossible by simple molds. Alternatively, the offset profile would require plunge and traverse type machining operations to construct a throttle body profile as shown at FIG. 4 in the patent.

Another known modification of throttle body wall profiles is shown in U.S. Pat. No. 3,047,277 to Landrum. This patent discloses a throttle body construction in which idling jets discharge fuel into the passage on one side of the passage. A portion of the peripheral wall of the throttle passage shrouds the throttle valve to restrict the flow of fluid on the other side of the throttle valve and force the fluid to flow only along the side carrying the idling jets of the passage. This patent teaches that by restricting the fluid flow to the area adjacent the fuel jets, the patented invention provides greater vaporization and mixture of the fuel and air so as to increase fuel economy. This disclosure does not contemplate or address any desensitizing of a throttle actuator throughout the low range of throttle movement. In addition, the wall profile disclosed by the patent restricts the maximum available flow rate through the throttle passage.

Another throttle passage profile construction is disclosed in U.S. Pat. No. 4,474,150 to Foley et al. Foley et al. teaches that recesses can be formed in the throttle passage walls to shroud the throttle plate during the low range of throttle movement from the closed throttle position. The profile is particularly configured at opposite edges of the throttle plate to permit greater than 90° displacement of the throttle plate. Like the apparatus disclosed by Shioyama, Foley et al. teaches that the apparatus will permit simplified calibration of a valve position sensor used for engine control. While purporting to simplify the construction of a modified wall profile in a throttle body, Foley et al. teaches a particular tool which must be used with a complicated machining apparatus such as plunge and traverse machines in order to provide the wall recesses. Furthermore, the recesses are not symmetrical along the longitudinal axis of passage and require two separate plunge and traverse machining operations to form the recesses in the diametrically opposed walls of the throttle body passage.

SUMMARY OF THE PRESENT INVENTION

The present invention overcomes the abovementioned disadvantages by providing a throttle body construction in which a convergent wall profile for shrouding the throttle plate within the low range of angular throttle plate displacement is formed by a venturi nozzle. As a result, the rate of change of fluid flow within the lower range of throttle plate angular displacement can be decreased without decreasing the maximum flow rate through the throttle passage. Moreover, such a construction is substantially easier to make as it permits simple die-casting or simple machining operations to be employed to produce the throttle wall profile. In addition, the invention provides a reduction in sensitivity of the throttle actuator at low throttle positions, and thus makes a motor vehicle employing the present invention substantially easier to drive under normally encountered traffic conditions. Furthermore, the present invention replaces the previously known and substantially more complicated throttle control linkages used to decrease the sensitivity of throttle actuators at the low range of angular throttle plate displacement.

In general, the throttle body includes a venturi nozzle having a convergent wall portion contoured in a predetermined contour adjacent the path of the periphery of the throttle plate throughout a predetermined throttle angle range. However, the venturi is generally shaped in accordance with known standards for nozzle design such as ISA (International Standards Association) or ASME (American Society of Mechanical Engineers) standard nozzle design for avoiding turbulence and pressure losses which restrict fluid flow through the passage. Moreover, while the general outline of a standard venturi nozzle design is relatively fixed, performance characteristics of the predetermined contour can be modified as desired by adjusting the wall profile angular duration, the closed throttle angle, the wall profile offset, the wall profile radius, and the plate clearance offset. Changes in such parameters permit the flow area exposed as a function of plate angular displacement to be controlled without restricting the maximum flow rate available in a throttle body having a known throttle passage diameter or area.

BRIEF DESCRIPTION OF THE DRAWING

The present invention will be more clearly understood by reference to the following detailed description of a preferred embodiment when read in conjunction with the accompanying drawing in which:

FIG. 1 is a diagrammatic view of a prior art mechanism used for reducing sensitivity of a throttle actuator at low range angular displacements of the throttle valve;

FIG. 2 is a sectional view of a throttle body construction according to the present invention.

DETAILED DESCRIPTION OF THE PRESENT INVENTION

Figure 3:
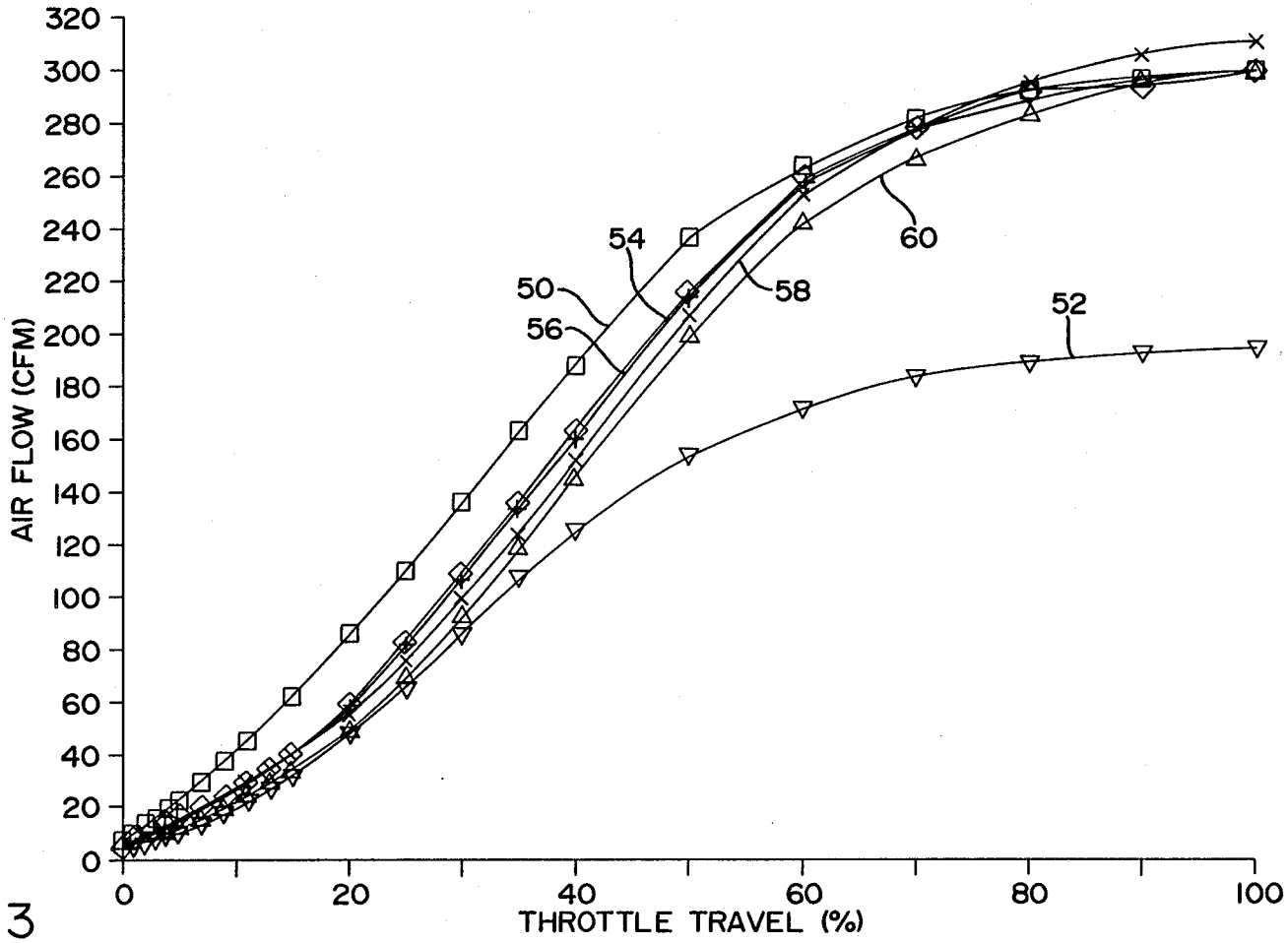
FIG. 3 is a graphic representation of performance characteristics of throttle body constructions to compare the throttle body of the present invention with performance characteristics of prior art structures.

Referring now to FIG. 2, a throttle body 30 can be constructed to replace the complicated mechanism 10 described with respect to FIG. 1. Consequently, as diagrammatically indicated at 22 in FIG. 2, an actuator can be directly linked to a valve plate control. For example, the prior art actuator output member 13 shown in FIG. 1, could be coupled to the lever 18 of FIG. 1.

The throttle body 30 includes a generally cylindrical throttle passage 32 having a diameter $D_T$ in which a throttle plate 34 is pivotally secured in the throttle body about a pivot axis 36 in the manner of well known butterfly valves. The pivot axis 36 is aligned on the longitudinal axis of the passage 32 as designated by the center lie at 38 and on a transverse axis as designated by the center line at 40.

The throttle body 30 also includes a venturi nozzle 42 whose profile is shown in FIG. 2. The venturi nozzle 42 has diameter $D_N$ determined in accordance with venturi nozzle standards which permit the fluid velocity to increase without inducing substantial pressure losses which restrict the flow of fluid through the throttle passageway 32. For example, the known ISA standard for optimal performance of a venturi nozzle, in which the venturi nozzle has a contour R which is a radius equal to one-third the diameter $D_N$ of the nozzle, can be selected. As a further example, ASME standards define nozzles haVing a Curvature R in the form of an ellipse, for example, an ellipse whose major diameter would be $\frac{1}{2}$ $D_T$ and whose minor diameter is $\frac{1}{2}$ $(D_T-D_N)$. In any event, the contour R avoids pressure differential which restricts air flow rate through the throttle passage.

In practice, it has been found that the converging or upper portion of the nozzle profile has greater effect upon the performance of the nozzle. So long as the lower wall portion is continuous, it need not diverge as shown in solid line, but could extend to the limit of the dotted line 33 shown in FIG. 2 provided that $D_N$ is not less than one-half of $D_T$, while still providing optimum venturi nozzle performance.

A converging wall portion 44 of the venturi nozzle 42 lies adjacent the path of the throttle plate 34 so as to restrict the throttle passage area which is opened at the initial or lower range of angular displacement of the throttle plate 34. The extent or angular duration ($\theta$W) of the converging wall portion can extend up to 30° from the closed throttle position without interfering with the venturi nozzle performance. However, the profile is considered to be most useful when the wall profile duration $\theta$W is limited within the range of 8°–16°. The angular duration $\theta$W would initiate, under ideal conditions, at the closed throttle engagement point on the throttle body wall. As a practical matter, the duration $\theta$W initiates at a point spaced apart from the point of closed throttle position by an amount referred to as the plate clearance offset 0P. The plate clearance offset is contemplated to be within a range of 0.0 to $0.1\times DT$, and as close to 0.0 as possible in order to provide only sufficient clearance for operation of the valve.

The converging wall portion 44 may be radiused. The focal point of the radius may be at or spaced from the pivot axis 36. However, as shown in the drawing, the focal point is aligned along the longitudinal axis 38 and apart from the transverse axis 40 by an amount referred to as the wall profile offset 0W. This range is advantageously limited to within the range of 0.0 to $0.1\times D_T$ for optimum operating conditions with a single radius of curvature for the converging wall portion 44. Use of a single radius equal to the radius of the throttle plate 34 is currently deemed most useful. However, it is to be appreciated that changes in the radius, including a complex contour with variations in the radius or a contour defined by multiple radii centered from spaced focal points, can be employed to customize the change in flow rate as desired. Furthermore, changes in wall profile offset 0W, plate clearance offset 0P, and angular wall duration $\theta$W can be introduced as desired to control the changes in flow rate.

In the preferred embodiment, the closed throttle point, i.e. the point at which the throttle plate 34 engages the peripheral wall of the throttle passage 32 when the throttle is at its closed throttle position, occurs with plate 34 angled within the traditional range of 0°–15° ($\theta$CT) from the transverse centerline 40. Nevertheless, it is to be understood that the invention is not limited to throttle body constructions in which the closed throttle angle $\theta$CT is so limited. However, it is also to be understood that the throttle construction of the present invention does not require the throttle plate to be angularly displaceable through a range greater than 90° in order to provide a desirable range of reduced flow change.

Referring now to FIG. 3, a graphic representation of the performance of a throttle body constructed in accordance with the present invention is shown. Plotted line 50 represents the air flow through a cylindrical throttle body passage, for example, a straight profile and having a diameter of 52 mm, throughout the full range of the throttle movement. Plotted line 52 represents the air flow of through throttle body having a cylindrical passageway of a smaller diameter, such as 42 mm, throughout the full range of throttle movement. Plotted line 52 is also representative of a curve which would occur in the previously known throttle body constructions wherein the throttle body wall configurations induce pressures which restrict maximum fluid flow through the throttle body passage.

Plotted lines 54, 56, 58 and 60 represent the air flow versus percentage of throttle travel as measured in a throttle body with a diameter $D_T$ of 52 mm and constructed in accordance with the present invention. Line 54 represents the performance of a throttle body construction in which the plate clearance offset OP is 0.5 mm and where the wall profile angular duration ($\theta$W) is 10% of total throttle travel 0T for example, $0.10\times 83°=8.3°$. Line 56 represents the performance of a throttle body constructed with a plate clearance offset OP set at 0.0 mm and a wall profile angular duration 0W set at 10% of $\theta$T i.e. 8.3°. Line represents a throttle body construction in which the plate clearance offset 0P is one millimeter and the wall profile angular duration OW is 15% of $\theta$T. Line 60 represents a throttle body structure in which the plate clearance offset 0P is 0.0 millimeters and wherein the wall profile angular duration $\theta$W is 15% of total throttle travel $\theta$T.

In each case, it will be understood that the curves 54, 56, 58 and 60 more nearly track the curve 52 throughout the low range of throttle travel. i.e approximately the first 30% of total throttle travel. As a result, sensitivity of the change of air flow to displacement of the throttle actuator, i.e. sensitivity of an accelerator pedal type actuator, is reduced in the low range of throttle travel. Nevertheless, the curves 54, 56, 58 and 60 demonstrate that the air flow rate at higher percentages of throttle travel approaches and attains maximum air flow rate through a simple cylindrical throttle passage having the same diameter DT. As a result, it will be appreciated that the maximum air flow rate is not limited by use of the throttle body wall to shroud the throttle plate throughout the low range of throttle travel.

In addition, it may be appreciated that the profile shown in FIG. 2 does not exhibit any negative draft areas which would require the use of complex mold parts in order to die cast a throttle body with a passage having the profile shown. Rather, two simple mold pieces which mate at the minimum diameter of the symmetrical venturi nozzle 42 could be utilized to form each throttle body passage. Furthermore, a throttle body with a venturi nozzle having a lower wall portion of the type shown in dotted line in FIG. 2 could be die cast with a single mold part. Moreover, in the event that machining is desired to construct a passageway in the throttle body, simple grinding or machining equipment which translate only along the axis 38 need by employed to form a profile shown in FIG. 2. Thus, the present invention avoids the need for complicated machining apparatus such as plunge and traverse machines to create a reduced sensitivity at a low range of throttle travel.

Having thus described the present invention, many modifications thereto will become apparent to those skilled in the art to which it pertains without departing from the scope and spirit of the present invention as defined in the appended claims.

What is claimed is:

1. In combination with an internal combustion engine having a throttle body with a fluid passageway and a butterfly type valve plate which is pivotally secured within the passageway for rotation about a valve axis extending perpendicularly to the centerline of the flow passage, the valve plate having a closed operative position relative to the passageway of the throttle body in which the peripheral edge of the valve plate engages the passageway defining wall, the valve plate being selectively pivoted about the axis from the closed position to a more open position characterized by movement of substantially half the peripheral edge in a generally upstream direction and movement of substantially half of the peripheral edge in a generally downstream direction, the improvement comprising: a venturi nozzle symmetrically positioned in the passageway and located downstream of the closed position of the valve plate and having a known standard configuration which does not substantially diminish flow through the passageway, the venturi nozzle having a converging wall portion with its upstream edge blended smoothly with the passageway and its contour formed by a circular radius struck from a point on the centerline of the passageway, the centerline being located slightly downstream from the axis of the valve so that the spacing between the converging wall and the downstream half of the valve's peripheral edge progressively increases as the valve is pivoted away from its closed position through a predetermined angular duration thereby gradually increasing flow through the passageway as the valve is opened substantially proportionally to the degree of pivotal opening movement of the valve plate thereby preventing a sudden large increase in flow just as the valve plate moves from the passageway wall as it begins to open.

2. The improvement as defined in claim 1 wherein the predetermined opening angular duration is between about zero to thirty degrees of initial valve plate movement from the closed position.

3. In combination with a motor vehicle having a throttle valve disposed in a throttle passageway for controlling fluid flow through the passageway and means for actuating the throttle valve including a displaceable accelerator pedal, the throttle valve including a butterfly type valve plate pivotally secured within the passageway for rotation about an axis extending perpendicularly to the centerline of the passageway, the plate having a closed operative position relative to the passageway in which its peripheral edge engages the passageway defining wall, the plate being selectively pivoted from the closed operative position to a more opened position characterized by movement of substantially half the plate's peripheral edge in a generally upstream direction and movement of substantially half of the plate's peripheral edge in a generally downstream direction, the improvement comprising: a venturi nozzle symmetrically positioned in the passageway and located downstream of the closed position of the valve plate and having a known standard configuration which does not substantially diminish flow through the passageway, the venturi nozzle having a converging wall portion with its upstream edge blended smoothly with the wall portion defining the passageway and its contour formed by a circular radius struck from a point on the centerline of the passageway, the centerline being located downstream from the axis of the valve so that the spacing between the converging wall and the downstream half of the valve's peripheral edge progressively increases as the valve is pivoted away from its closed position through a predetermined angular duration thereby gradually increasing flow through the passageway as the valve is opened substantially proportionally to the degree of pivotal opening movement of the valve plate caused by displacement of the accelerator pedal thereby preventing a sudden large increase in flow just as the valve plate moves from the passageway wall as it begins to open.

4. The improvement as defined in claim 3 wherein the predetermined angular duration is between about zero to thirty degrees of initial valve plate movement from the closed position.

* * * * *